US006176402B1

(12) United States Patent
Rogers

(10) Patent No.: US 6,176,402 B1
(45) Date of Patent: Jan. 23, 2001

(54) ANKLE HOLSTER SYSTEM

(75) Inventor: William H. Rogers, Jacksonville, FL (US)

(73) Assignee: Safariland Ltd., Ontario, CA (US)

( * ) Notice: Under 35 U.S.C. 154(b), the term of this patent shall be extended for 0 days.

(21) Appl. No.: 09/422,165

(22) Filed: Oct. 22, 1999

(51) Int. Cl.[7] ..... A45F 5/00; F41C 33/04

(52) U.S. Cl. ..... 224/222; 224/267; 224/901.8; 224/911

(58) Field of Search ..... 224/191, 222, 224/267, 197, 198, 587, 666, 911, 901.8

(56) References Cited

U.S. PATENT DOCUMENTS

| | | | | |
|---|---|---|---|---|
| 1,209,401 | * | 12/1916 | Crouse | 224/222 X |
| 1,282,878 | * | 10/1918 | Lagois | 224/222 X |
| 3,610,487 | * | 10/1971 | Campos | 224/911 X |
| 4,029,242 | * | 6/1977 | Stoesser | 224/222 |
| 4,044,933 | * | 8/1977 | Artz | 224/666 |
| 4,258,871 | * | 3/1981 | McMahon | 224/911 X |
| 4,410,118 | * | 10/1983 | Taurisano | 224/222 |
| 4,667,374 | * | 5/1987 | Bianchi | 224/911 X |
| 4,705,086 | * | 11/1987 | O'Neill | 224/587 X |
| 4,830,247 | * | 5/1989 | Banks | 224/197 X |
| 4,881,671 | * | 11/1989 | Horton et al. | 224/222 |
| 5,058,788 | * | 10/1991 | Newmark | 224/911 X |
| 5,351,370 | * | 10/1994 | Fields et al. | 224/222 X |
| 5,381,922 | * | 1/1995 | Gladman et al. | 224/666 |
| 5,412,545 | * | 5/1995 | Rising | 224/197 X |
| 5,445,303 | * | 8/1995 | Cawile, Jr. | 224/222 |
| 5,727,341 | * | 3/1998 | Saylor | 224/911 X |
| 5,850,955 | * | 12/1998 | Barr | 224/222 |
| 5,934,531 | * | 8/1999 | Jablonic et al. | 224/222 |
| 5,988,467 | * | 11/1999 | Brustein | 224/222 |

FOREIGN PATENT DOCUMENTS

| | | | | |
|---|---|---|---|---|
| 72856 | * | 12/1947 | (NO) | 224/222 |

OTHER PUBLICATIONS

Cash 'n Card Caddy; Quikey Catalogue, 1991.*

* cited by examiner

*Primary Examiner*—Gregory M. Vidovich
(74) *Attorney, Agent, or Firm*—Arthur G. Yeager

(57) ABSTRACT

An ankle holster system, for carrying a concealed handgun includes a vertical support member that engages footwear worn by a user to provide vertical support for a holster and handgun. Cooperating releasable fasteners are mounted on the holster and the support member for securing the holster to the support member. A retainer strap wraps around the leg and the holster to secure the holster against rotative movement and attaches to the holster by another pair of cooperating releasable fasteners. The support member may include a strap to secure it to the leg of a user in the case of a heavy gun and holster that could cause outward bowing of the support member. The support member includes a planar metal element that can be bent in its plane and perpendicular to its plane but is rigid in the vertical direction to minimize vertical movement of the holster but allow for flexing necessary at the ankle and foot. The system includes a support member for use with boots and a longer support member for use with shoes. A flexible cylindrical cloth cuff member may be worn under the holster to increase comfort if the system is used with thin socks.

17 Claims, 4 Drawing Sheets

ANKLE HOLSTER SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The present invention relates to ankle holster assemblies for carrying a concealed handgun.

DESCRIPTION OF RELATED ART

There are a wide variety of holsters used to carry concealed firearms at or near the ankle of a wearer. In the holsters known to the prior art the straps securing the holster to the leg are uncomfortably very tight in order to retard downward movement of the holster and weapon. Improvements are needed to provide for long and comfortable wearability and for preventing downward movement of the holster and gun during walking or running as well as retarding any upward movement of the holster when the gun is being withdrawn from the holster.

BRIEF SUMMARY OF THE INVENTION

In one aspect of the present invention there is provided an ankle holster system for removably securing a handgun to a leg of a wearer comprising a holster having a first sidewall disposable adjacent the leg of a wearer and a second sidewall disposable away from the leg of a wearer and having an interior pocket therebetween for removably carrying a handgun therein. A support member for securing the holster adjacent the leg of a wearer is included along with releasable cooperating fastener means attached to the holster and the support member for securing the holster to the support member. The support member includes means for removably engaging footwear worn by a wearer for supporting the weight of a handgun and for inhibiting vertical movement of the support member and the holster attached thereto. The system also includes a retainer strap for encircling the holster adjacent the second sidewall and the leg of a wearer for inhibiting rotative movement of the holster around the leg of a wearer.

Other aspects of the invention include second releasable cooperating fastener means attached between the holster and to the retainer strap for securing the holster to the retainer strap. The retainer strap is adjustable in length. The support member includes a clip with a throat smaller than the upper edge of the footwear disposed in a space above the throat. The means for removably engaging also includes a hook member for fitting over an upper edge of the footwear worn on a leg of a wearer. The hook member is shaped to inhibit vertical removal thereof from the top edge of the footwear. The support member includes an elongate planar body having an upper portion and a lower portion, the means for removably engaging being located adjacent the lower portion and the releasable cooperating fastener means attached to the support member is located adjacent the upper portion. There is a pivot means between the means for removably engaging and said lower portion.

In another aspect of the present invention there is provided an ankle holster system for removably securing a handgun to a leg of a wearer comprising a holster having a first side disposable the leg of a wearer and a second side disposable away from the leg of a wearer and defining an interior pocket for removably carrying a handgun therein and a vertically disposed support member for securing the holster vertically with respect to the leg of a wearer. There is also a support member having an upper portion and a lower portion and releasable cooperating fastener means attached to the holster and to the upper portion of the support member for securing the holster to the upper portion of the support member. The lower portion of the support member includes means for removably engaging footwear worn by a wearer for inhibiting vertical movement of the support member and the holster attached thereto and for supporting the weight of a handgun.

Other features of the invention include a retainer strap of adjustable length for encircling the holster adjacent the second sidewall and the leg of a wearer for inhibiting rotative movement of the holster around the leg of a wearer. The means for removably engaging includes a hook member located adjacent the lower portion for fitting over an upper edge of the footwear worn on one leg of a wearer and the support member includes an elongate planar body, the body being bendable in its plane and bendable perpendicular to its plane and rigid with respect to length along its longitudinal axis. Also included is a cuff sized to fit around the calf of a wearer and beneath the holster and the support member. Third releasable cooperating fastener means is attached to the cuff and the upper portion of the support member for inhibiting movement of the support member and the holster attached thereto. There is also included an adjustable securing strap attached generally medially of the support member for securing the support member to the leg of a wearer to inhibit bowing outwardly of the support member from the leg.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
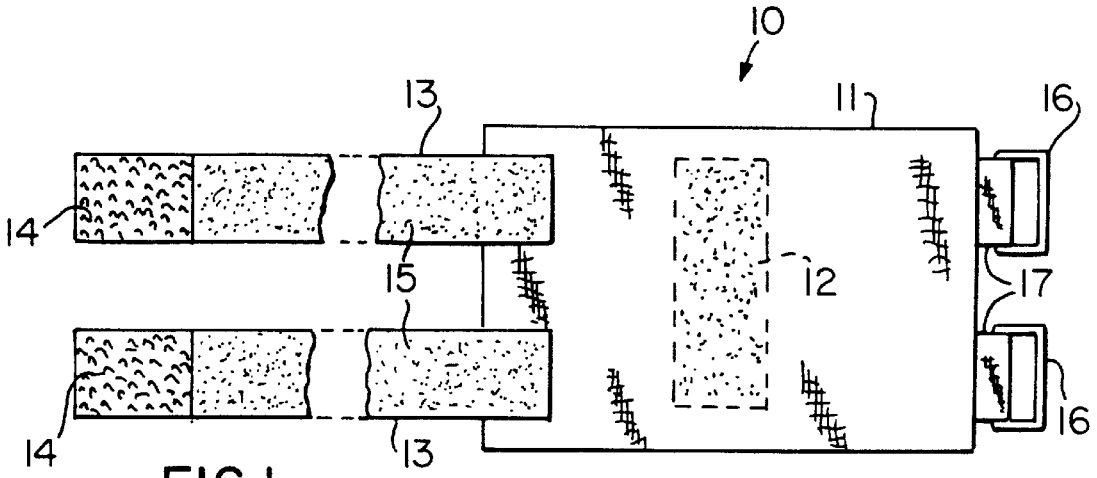
FIG. 1 is a plan view of the holster retainer strap in accord with the ankle holster system of the present invention.

Referring now to the drawings, FIG. 1 illustrates a holster retainer strap 10 used in the ankle holster system that wraps around a leg of a wearer and around a holster to securely but comfortably maintain it in place. The strap 10 includes an attachment panel 11 onto which is attached a fastener pad 12 (shown stitched to the opposite side of the panel 11) that is preferably made of loop fastening material, well known of the Velcro type or the like. Two elongate straps 13 are stitched to panel 11. Each strap 13 includes an elongate strip 15 of loop fastening material extending substantially the length of the strap 13. A pad 14 of hook fastening material is stitched to the ends of the straps 13. A second pair of short straps 17, generally aligned with respective straps 13, are stitched to panel 11 and support metal buckle loops 16. Panel 11 wraps around a user's leg carrying a holster 28 via pad 12 and straps 13 wrap around a user's leg and the holster 28 and inserted through loops 16 and folded over loops 14 to attach pads 14 to a desired location along strips 15 as more clearly illustrated in FIG. 6.

Figure 2:
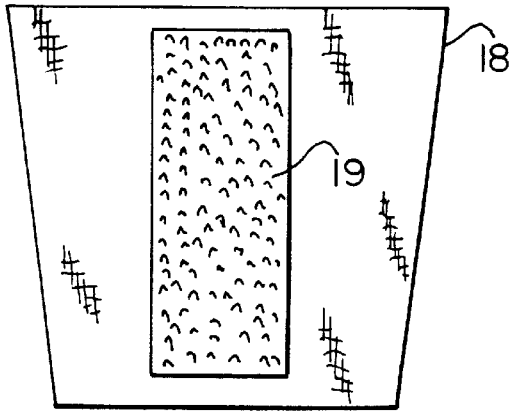
FIG. 2 is a plan view of an optional calf band used in the present invention.
Figure 6:
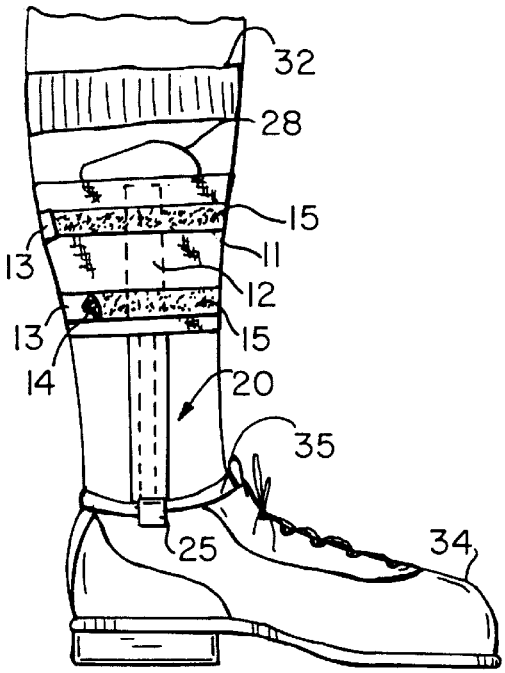
FIG. 6 is a side pictorial view of the ankle holster system according to this invention attached between a leg and a shoe of a wearer.

FIG. 2 illustrates an optional tapered cuff or calf band 18 worn next to the leg to provide for padding and cooling when a user, for example, is not wearing thick socks 32, shown in FIG. 6. A pad 19 of hook fastening material is provided for attachment to a holster support member 20 as will be discussed hereinbelow.

Figure 3:
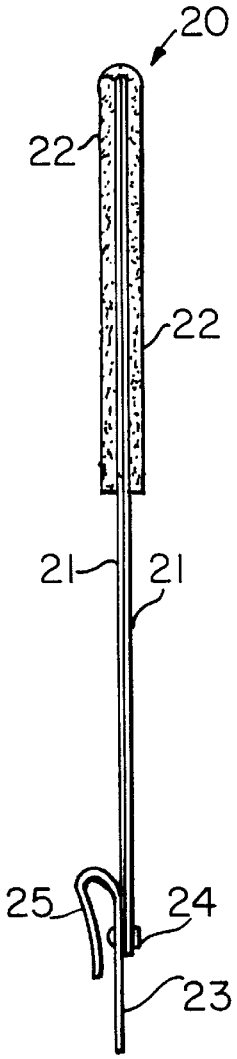
FIG. 3 is a side elevational view of a vertical holster support strap in accord with the present invention.
Figure 4:
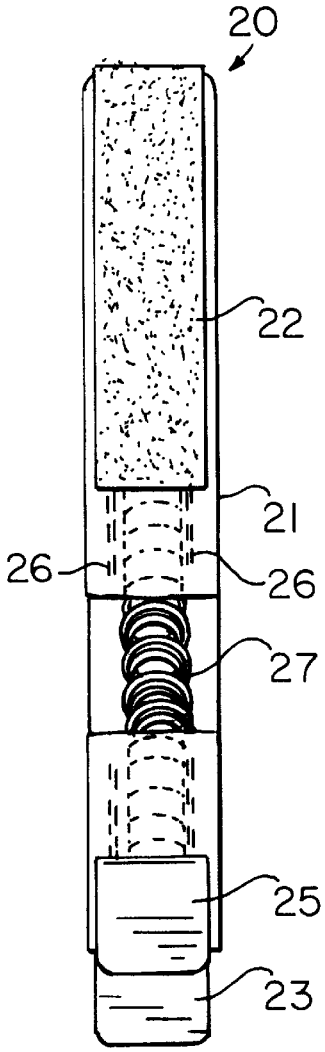
FIG. 4 is a front elevational view of the strap of FIG. 3 including a cutout section depicting a portion of the spring stay sandwiched between a pair of sides of the strap.
Figure 5:
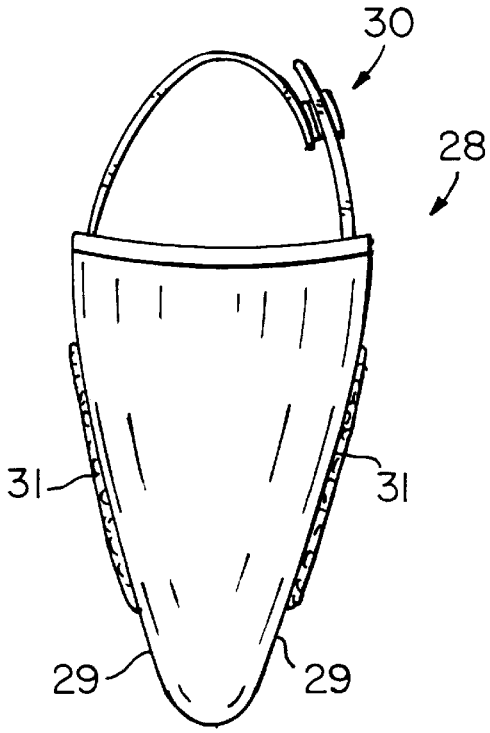
FIG. 5 is a holster used in the present invention.

With respect now to FIGS. 3 and 4, the vertically disposed holster support member in the form of a strap 20 is illustrated. The elongate body 21 has a fastener strip 22 that extends over the top of body 21 and downwardly a distance of approximately 4–6 inches and is comprised of loop fastening material. At the lower portion of main body 21 is a clip formed by a planar support element 23 pivotally or rotatably attached to main body 21 via bolt and nut 24 or other fastening means like a rivet. This pivot connection 24 between the clip 23, 25 facilitates the pivotal movement of the foot with respect to the leg at the ankle of the user and reduces the relative motion between the strap 20 and clip 23,25 and the leg and foot of the user. The upper portion of element 23 is formed as a depending hook member 25 that fits over the welt or cuff 35 of a shoe and outwardly thereof to support the weight of the handgun and inhibit vertical movement of the strap 20. The main body 21 of the strap 20 comprises two layers 21 of material enclosing a planar elongate strap member forming a stay 27 via stitching 26. The stay 27 is bendable in its plane and can flex outwardly perpendicular to its plane over a user's ankle bone but is rigid with respect to its long axis to resist vertical extension or compression to maintain an attached holster securely in position and supported thereby. Preferably, stay 27 is formed of metal and is substantially the same length as body members 21. FIG. 5 illustrates a holster 28 having opposite sides 29 and two hook fastener pads 31 attached thereto. A thumb-break securing strap 30 is mounted thereon to secure a gun in the holster 28. It is to be understood that a wide variety of holsters may be used in the present invention depending upon the type of gun that is to be carried and the strap 30 may not be necessary, as understood in the art.

Figure 7:
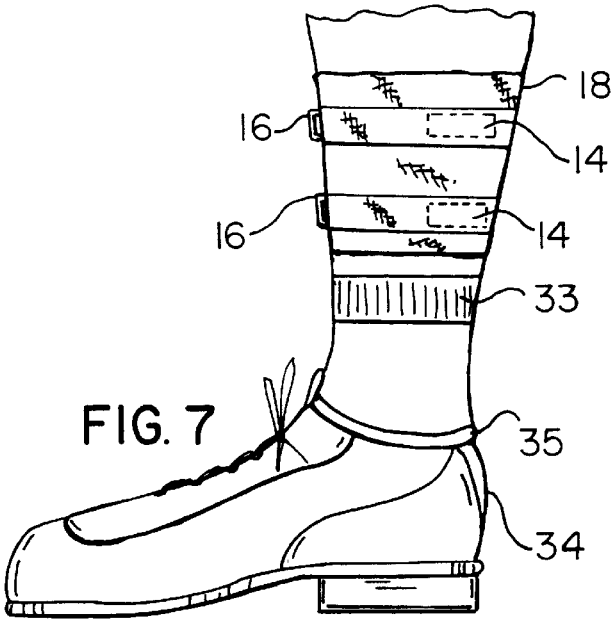
FIG. 7 is a side pictorial view opposite to FIG. 6 of the ankle holster system using the calf band of FIG. 2.

FIGS. 6 and 7 illustrate the attachment apparatus as used with a user's shoe 34 having upper cuff 35. Vertical stay 20 is mounted to the inside of the leg with clasp hook member 25 fitting over cuff 35 of the shoe 34. The loop fastener pad 22 of strap 20 attaches to hook fastener pad 31 of the holster 28 at the desired height and cant. The holster retainer strap 10 is then wrapped around the secured holster placing loop fastener pad 12 thereof against the opposite hook fastener pad 31 on holster 28. The straps 13 are then positioned through loops 16 and adjusted as desired in a snug but comfortable manner.

In FIG. 7, calf band 18 is used on the leg before the above described attachment to the leg. In such a case, the hook fastener pad 19 of cuff 18 is mated with the loop fastener pad 22 of strap 20 on the inside of vertical support member 20.

Figure 8:
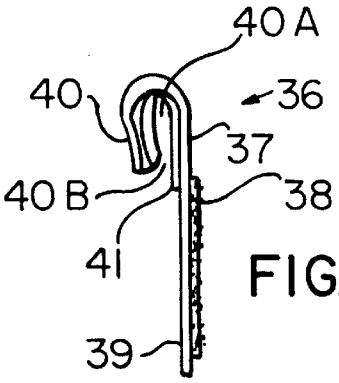
FIG. 8 is a side elevational view of the vertical holster support pad used with the ankle holster system in accord with the present invention for attachment to a boot.
Figure 9:
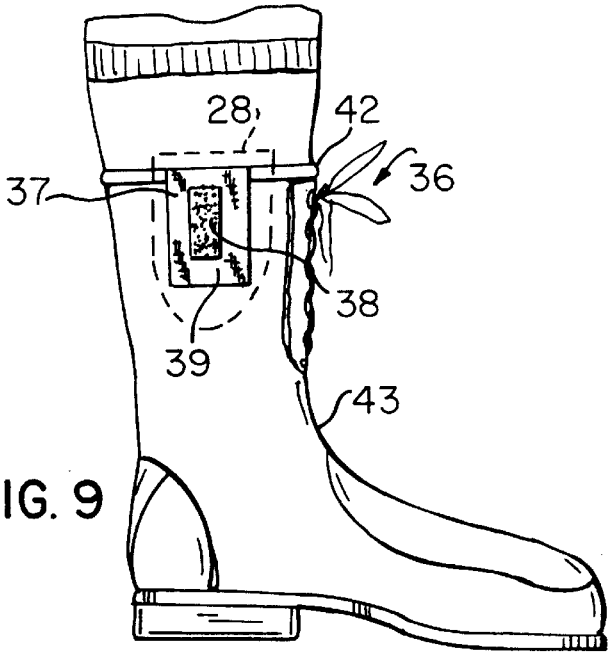
FIG. 9 is a side pictorial view of the support pad of FIG. 8 attached to a boot top.

FIG. 8 illustrates vertical holster support pad 36 for use with below the calf boots. The pad 36 includes a substantially rigid body 37 having a generally planar member 39 that supports loop fastener pad 38 and extends into a clip in the form of a hook member portion 40. An additional reinforcing hook element 41 is secured inside hook member 40 to provide extra rigidity and to form the hook member portion 40 concave to provide a stop so that the pad 36 will not be inadvertently removed from the boot. In FIG. 9, the holster support pad 36 is shown attached to the cuff or top 42 of a boot 43. The pad 36 is attached to the boot 43 by threading the end of cuff 42 through hook space 40A, the throat 40B being substantially smaller than cuff 42 to inhibit removal of the pad 36 upwardly. Hook member portion 40 and reinforcing hook element 41 are inside the boot 43. The remaining apparatus, main strap 10 and holster 28, is attached to the pad 38 and surrounded by the main strap assembly 10.

Figure 10:
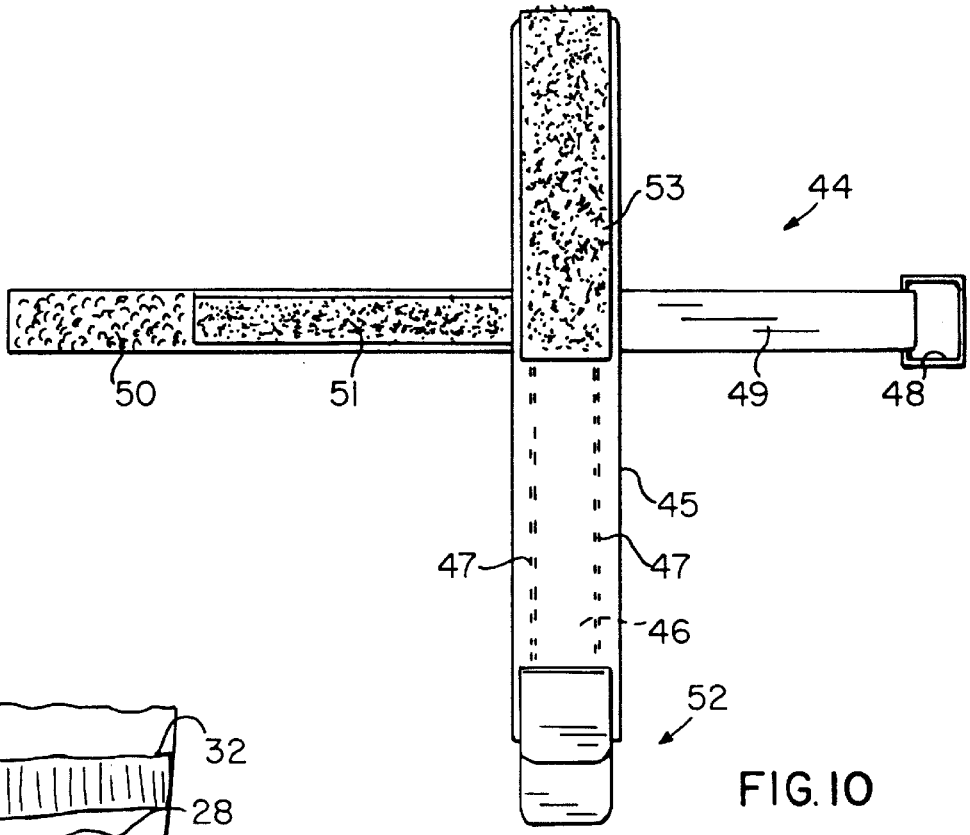
FIG. 10 is an alternate embodiment of the vertical holster support strap.

With regard to FIG. 10, an alternate embodiment of the vertical support strap 44 includes main body 45 enclosing a vertical elongate stay 46 enclosed via stitching 47, identical to stay 27, and loop fastening means 53 at the upper portion and clip assembly 52 identical to clip 23, 25 of FIGS. 3 and 4 at the lower portion. In this embodiment, a horizontally disposed strap 49 is attached to body 45 and includes a metal buckle loop 48 at one end and two strips of fasteners at the other end in the form of loop member 51 and hook member 50. This support strap is used in applications where the gun carried is large and heavy and usually worn higher than shown in FIGS. 6, 7, and 9. Strap 49 prevents excessive outward bowing of the main body 45 under such conditions.

The present invention has been described with reference to cooperating releasably hook and loop fasteners such as those that sold as Velcro in order to be continuously adjustable for comfort and reliability. It is to be understood however that other means such as snap fasteners or sliding fastener straps and buckles may be used if desired in the circumstances.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. An ankle holster system for removably securing a handgun to a leg of a wearer comprising a holster having a first sidewall disposable adjacent a leg of a wearer and a second sidewall disposable away from a leg of a wearer and having an interior pocket therebetween for removably carrying a handgun therein, a support member for securing said holster adjacent a leg of a wearer, releasable cooperating fastener means attached to said holster and said support member for securing said holster to said support member, said support member including means for removably engaging footwear worn by a wearer for supporting the weight of a handgun and for inhibiting vertical movement of said support member and said holster attached thereto and a retainer strap encircling said holster adjacent said second sidewall and a leg of a wearer for inhibiting rotative movement of said holster around a leg of a wearer.

2. The system as defined in claim 1 further including second releasable cooperating fastener means attached between said holster and said retainer strap for securing said holster to said retainer strap.

3. The system as defined in claim 1 wherein said retainer strap is adjustable in length.

4. The system as defined in claim 1 wherein said support member includes a clip with a throat smaller than an upper edge of footwear disposable in said clip in a space above said throat.

5. The system as defined in claim 1 wherein said means for removably engaging includes a hook member for fitting over an upper edge of footwear worn on a leg of a wearer.

6. The system as defined in claim 5 wherein said hook member is shaped to inhibit vertical removal thereof from an upper edge of footwear.

7. The system as defined in claim 1 wherein said support member includes an elongate planar body having an upper portion and a lower portion, said means for removably engaging being located adjacent said lower portion.

8. The system as defined in claim 7 wherein said releasable cooperating fastener means attached to said support member is located adjacent said upper portion.

9. The system of claim 7 further comprising a pivot means between said means for removably engaging and said lower portion.

10. An ankle holster system for removably securing a handgun to a leg of a wearer comprising a holster having a first side disposable adjacent the leg of a wearer and a second side disposable away from a leg of a wearer and defining an interior pocket for removably carrying a handgun therein, a vertically disposed support member for securing said holster vertically with respect to a leg of a wearer, said support member having an upper portion and a lower portion, releasable cooperating fastener means attached to said holster and said upper portion of said support member for securing said holster to said upper portion of said support member, said lower portion of said support member including means for removably engaging footwear worn by a wearer for inhibiting vertical movement of said support member and said holster attached thereto and for supporting the weight of a handgun, and a retainer strap encircling said holster adjacent said second side and a leg of a wearer for inhibiting rotative movement of said holster around a leg of a wearer.

11. The system as defined in claim 10 further including second releasable cooperating fastener means attached between said holster and said retainer strap for securing said holster to said retainer strap.

12. The system as defined in claim 11 wherein said retainer strap is adjustable in length.

13. The system as defined in claim 10 wherein said means for removably engaging includes a hook member located adjacent said lower portion for fitting over an upper edge of footwear worn on one leg of a wearer.

14. The system as defined in claim 10 wherein said support member includes an elongate planar body, said body being bendable in its plane and bendable perpendicular to its plane and rigid with respect to length along its longitudinal axis.

15. The system as defined in claim 10 further including a cuff sized to fit around calf of a wearer and beneath said holster and said support member.

16. The system as defined in claim 15 further including second releasable cooperating fastener means attached to said cuff and said upper portion of said support member for inhibiting movement of said support member and said holster attached thereto.

17. The system as defined in claim 10 further including an adjustable securing strap attached generally medially of said support member for securing said support member to a leg of a wearer to inhibit bowing outwardly of said support member therefrom.

* * * * *